US008262890B2

(12) United States Patent
Meade

(10) Patent No.: US 8,262,890 B2
(45) Date of Patent: Sep. 11, 2012

(54) ELECTRODEPOSITION PAINTING SYSTEMS AND METHODS FOR ELECTRODE STERILIZING IN ELECTRODEPOSITION PAINTING SYSTEMS

(75) Inventor: James Walter Meade, Richmond, KY (US)

(73) Assignee: Toyota Motor Engineering & Manufacturing North America, Inc., Erlanger, KY (US)

( * ) Notice: Subject to any disclaimer, the term of this patent is extended or adjusted under 35 U.S.C. 154(b) by 311 days.

(21) Appl. No.: 12/791,450

(22) Filed: Jun. 1, 2010

(65) Prior Publication Data

US 2011/0290652 A1 Dec. 1, 2011

(51) Int. Cl.
*C25D 13/00* (2006.01)
*C25D 1/12* (2006.01)

(52) U.S. Cl. ..... 204/626; 204/622; 204/623; 204/471; 204/472; 204/480; 204/482; 204/512

(58) Field of Classification Search ..... 204/471, 204/472, 480, 482, 512, 622, 623, 626; 422/28, 422/186.04, 186.07
See application file for complete search history.

(56) References Cited

U.S. PATENT DOCUMENTS 4,416,854 A 11/1983 Nielsen
4,525,272 A 6/1985 Henson
4,643,815 A * 2/1987 Blankemeyer ..... 204/473
5,569,388 A 10/1996 Kubo
6,860,990 B2 3/2005 Bartl et al.
7,591,931 B2 9/2009 Eguchi
2002/0014464 A1 2/2002 Murphy, Jr.
2005/0010321 A1 * 1/2005 Contos et al. ..... 700/123
2006/0180552 A1 8/2006 Downs
2007/0264357 A1 11/2007 King et al.
2008/0118396 A1 * 5/2008 De Meulenaer et al. ..... 422/20
2009/0218229 A1 9/2009 Shrewsburg et al.
2010/0015245 A1 1/2010 Harrison et al.

* cited by examiner

*Primary Examiner* — Bruce Bell
(74) *Attorney, Agent, or Firm* — Dinsmore & Shohl LLP

(57) ABSTRACT

Electrodeposition painting systems may include an electrodeposition bath containing an electrodeposition paint solution, wherein the electrodeposition paint solution is in contact with an electrodeposition bath anode that charges the paint such that it electrocoats parts submerged therein to form electrocoated parts, a rinse tank that rinses the electrocoated parts, wherein a rinse tank reservoir of the rinse tank is capable of fluid communication with the electrodeposition bath, a filter that filters the electrodeposition paint solution to separate filtered water from the paint, and an ionizer assembly including one or more electrodes in contact with the filtered water and a power supply connected to the one or more electrodes, wherein the power supply causes a plurality of electrode ions from the one or more electrodes to enter the filtered water to produce filtered water including electrode ions such that the filtered water including electrode ions flows into and sterilizes the electrodeposition paint solution.

20 Claims, 3 Drawing Sheets

ELECTRODEPOSITION PAINTING SYSTEMS AND METHODS FOR ELECTRODE STERILIZING IN ELECTRODEPOSITION PAINTING SYSTEMS

TECHNICAL FIELD

The present specification generally relates to electrodeposition painting and, more specifically, electrode sterilizing in electrodeposition painting processes and systems.

BACKGROUND

Electrodeposition paint systems can provide a consistent process for coating numerous parts with the same paint. During electrodeposition painting, a part is submerged in an electrodeposition paint solution and a voltage is applied there between. As a result of the applied voltage, the paint in the paint solution becomes charged and is attracted to the submerged part. The electrocoated part is then removed from the electrodeposition paint solution so that excess paint may be removed via one or more rinsing cycles. Throughout the electrodeposition painting process, the electrodeposition paint solution may be constantly filtered and monitored to ensure the proper paint levels are maintained. Furthermore, bacteria levels, which can increase due to the various paint ingredients in the electrodeposition paint solution, may also be monitored and reduced to allow for consistent electrocoating. For example, biocides such as mazide may be continuously added to the electrodeposition painting system to reduce the amount of bacteria present. However, biocides can be cost prohibitive and limited in their effectiveness.

Accordingly, a need exists for alternative sterilizing methods for electrodeposition painting systems.

SUMMARY

In one embodiment, an electrodeposition painting system may include an electrodeposition bath containing an electrodeposition paint solution including paint and water, wherein the electrodeposition paint solution is in contact with an electrodeposition bath anode that charges the paint such that it electrocoats one or more parts submerged in the electrodeposition paint solution to form one or more electrocoated parts, a rinse tank that rinses the one or more electrocoated parts, wherein a rinse tank reservoir of the rinse tank is capable of fluid communication with the electrodeposition bath, a filter that filters the electrodeposition paint solution to separate filtered water from the paint, and an ionizer assembly including one or more electrodes in contact with the filtered water and a power supply connected to the one or more electrodes, wherein the power supply causes a plurality of electrode ions from the one or more electrodes to enter the filtered water to produce filtered water including electrode ions such that the filtered water including electrode ions flows into and sterilizes the electrodeposition paint solution.

In another embodiment, a method for electrode sterilizing in an electrodeposition painting system is provided. The method may include electrocoating one or more parts in an electrodeposition paint solution to form one or more electrocoated parts, wherein the electrodeposition paint solution comprises water and paint, filtering out filtered water from the paint of the electrodeposition paint solution, passing the filtered water through an ionizer assembly and adding a plurality of electrode ions to the filtered water to form filtered water comprising electrode ions, rinsing the one or more electrocoated parts with the filtered water comprising electrode ions in a rinse tank, and collecting the filtered water comprising electrode ions in a rinse tank reservoir, the filtered water comprising electrode ions flowing into and sterilizing the electrodeposition paint solution.

In yet another embodiment, an electrodeposition painting system may include an electrodeposition bath containing an electrodeposition paint solution including paint and water, wherein the electrodeposition paint solution is in contact with an electrodeposition bath anode that charges the paint such that it electrocoats one or more parts submerged in the electrodeposition paint solution to form one or more electrocoated parts, a rinse tank that rinses the one or more electrocoated parts, wherein a rinse tank reservoir of the rinse tank is capable of fluid communication with the electrodeposition bath, a filtering water circuit in fluid communication with the electrodeposition bath configured to filter the paint from the water to provide filtered water, and a sterilizing circuit that receives filtered water from the rinse tank, the sterilizing circuit including an ionizer assembly that introduces electrode ions to the filtered water.

These and additional features provided by the embodiments described herein will be more fully understood in view of the following detailed description, in conjunction with the drawings.

BRIEF DESCRIPTION OF THE DRAWINGS

The embodiments set forth in the drawings are illustrative and exemplary in nature and not intended to limit the subject matter defined by the claims. The following detailed description of the illustrative embodiments can be understood when read in conjunction with the following drawings, where like structure is indicated with like reference numerals and in which:

DETAILED DESCRIPTION

Figure 1:
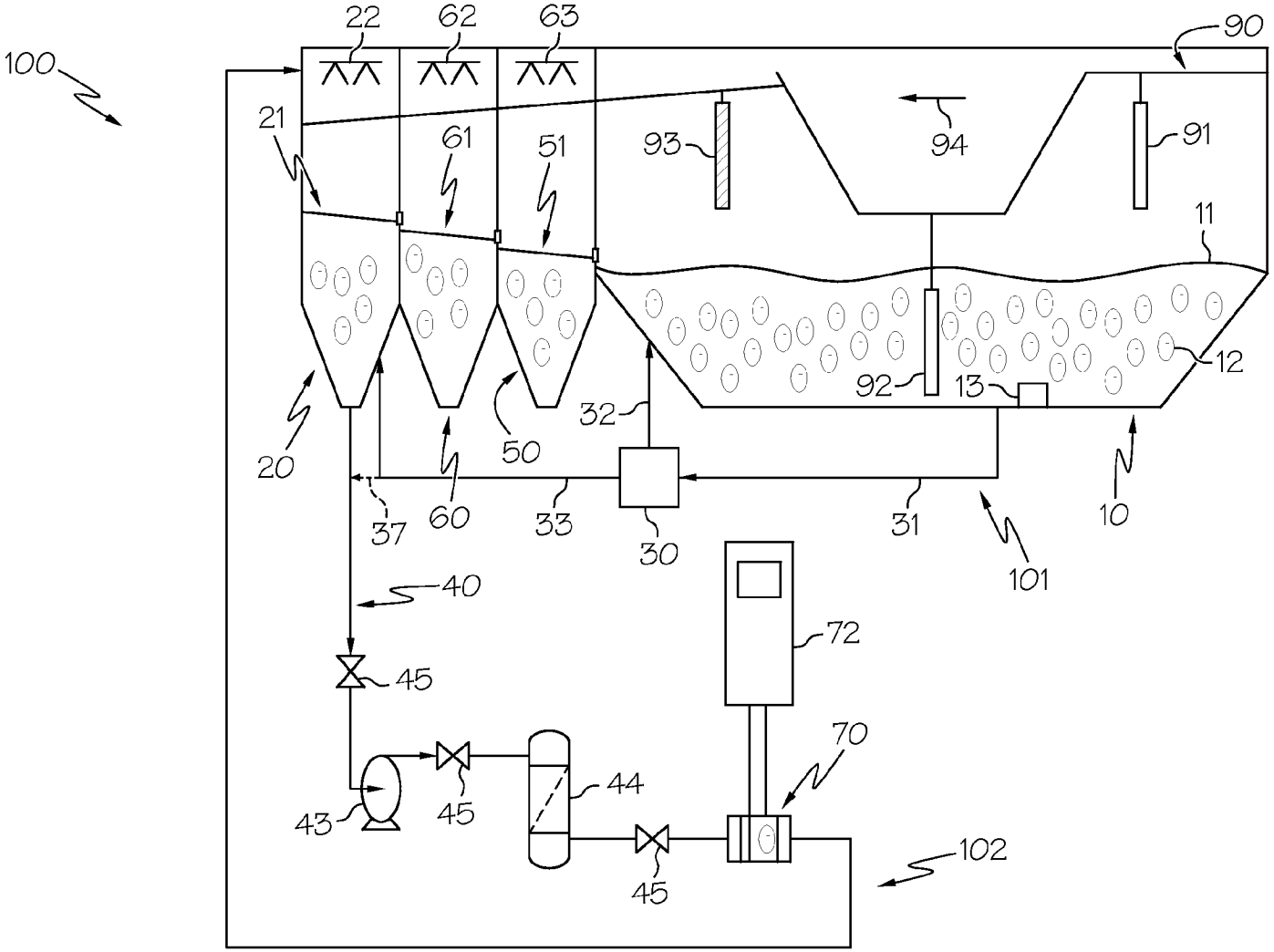
FIG. 1 depicts an electrodeposition painting system and method according to one or more embodiments shown and described herein.

FIG. 1 generally depicts one embodiment of an electrodeposition painting system and method for electrocoating one or more parts. The electrodeposition painting system can generally comprise an electrodeposition bath, a rinse tank, a filter and an ionizer assembly. The electrodeposition bath contains an electrodeposition paint solution comprising paint and water in contact with an electrodeposition bath anode that charges the paint. As the one or more parts are submerged in the electrodeposition paint solution, the charged paint is attracted to the one or more parts causing them to become electrocoated. The one or more electrocoated parts are then transported to a rinse tank to rinse away excess paint and material. In cooperation with this process, a filter may continuously filter the electrodeposition paint solution to separate the paint from filtered water. The paint can be reintroduced to the electrodeposition bath and filtered water can pass through the ionizer assembly, either directly from the filter or after passing through the rinse tank. The ionizer assembly, which comprises one or more electrodes in contact with the filtered water, can introduce a plurality of electrode ions into the filtered water. The filtered water comprising electrode ions can then flow throughout the electrodeposition painting system and sterilize (i.e., reduce the amount of bacteria in) the electrodeposition paint solution. Various embodiments of the electrodeposition painting system and the operation of the electrodeposition painting system will be described in more detail herein.

Referring to FIG. 1, an electrodeposition painting system 100 is illustrated comprising a part carrier assembly 90 that can transport one or more parts 91, 92, 93 from an electrodeposition bath 10, to a rinse tank 20 (and potentially to a first additional rinse tank 50 and a second additional rinse tank 60 there between). The part carrier assembly 90 can comprise any carrier assembly that can transport the one or more parts 91, 92, 93 between the various components of the electrodeposition painting system 100 so that the one or more parts 91, 92, 93 can be electrocoated. For example, in one embodiment, the part carrier assembly 90 may comprise a chain-type conveyor where each of the one or more parts 91, 92, 93 move synchronously. In such an embodiment, the chain-type conveyor may transport the one or more parts 91, 92, 93 at a continuous speed, at a variable speed, or in incremental distances such that the one or more parts 91, 92, 93 stop for a period of time in each component of the electrodeposition painting system 100. In another embodiment, the part carrier assembly 90 may comprise individual transports that can be independently paired with each of the one or more parts 91, 92, 93 such that each of the one or more parts 91, 92, 93 can traverse through the electrodeposition painting system 100 independent of one another. Such an embodiment may allow for an electrocoated part 93 to advance towards the rinse tank 20 while a submerged part 92 stays submerged in the electrodeposition paint solution 11 for an extended period of time as will become appreciated herein. The part carrier assembly 90 may comprise any other apparatus that can independently or jointly transport one or more parts 91, 92, 93 between the various components of the electrodeposition painting system 100.

In addition, the one or more parts 91, 92, 93 may comprise any type of part that can be electrocoated in an electrodeposition bath 10. Specifically, as will become appreciated herein, the one or more parts 91, 92, 93 can comprise any material that attracts paint in an electrodeposition paint solution 11 contained in an electrodeposition bath 10 when a voltage is applied between the one or more parts 91, 92, 93 and the electrodeposition paint solution 11. For example, in one embodiment, the one or more parts 91, 92, 93 may comprise metallic parts such as metallic parts for automobiles. In another embodiment, the one or more parts 91, 92, 93 may be pretreated, such as, for example, by undergoing a cleaning or coating prior to entering the electrodeposition bath 10.

Referring still to FIG. 1, the electrodeposition bath 10 may comprise any apparatus that can contain a sufficient amount of an electrodeposition paint solution 11 in contact with an electrodeposition bath anode 13 to allow for the one or more parts 91, 92, 93 to be submerged in the electrodeposition paint solution 11 and electrocoated with the paint contained in the electrodeposition paint solution 11. For example, in one embodiment, the electrodeposition bath 10 may comprise a large vat holding a volume of electrodeposition paint solution 11 of approximately 45,700 gallons. In another embodiment, the electrodeposition bath 10 may comprise a smaller volume such as where the one or more parts 91, 92, 93 are relatively small and do not require a significant depth for submersion. In yet another embodiment, such as where the part carrier assembly 90 continuously transports the one or more parts 91, 92, 93 through the electrodeposition painting system 100, the electrodeposition bath 10 may comprise a length that allows for enough submersion time while the one or more parts 91, 92, 93 are traveling through the electrodeposition paint solution 11 to provide a complete electrocoat with the paint. In an alternative embodiment, such as where the part carrier assembly 90 transports the one or more parts 91, 92, 93 incrementally (such that each of the one or more parts 91, 92, 93 may remain stationary when at the electrodeposition bath 10), the electrodeposition bath 10 may comprise a much shorter length.

The electrodeposition bath 10 may therefore contain a volume of the electrodeposition paint solution 11 for electrocoating the one or more parts 91, 92, 93. The electrodeposition paint solution 11 may comprise any solution that will electrocoat the one or more parts 91, 92, 93 when submerged in the electrodeposition paint solution 11 and when a voltage is applied between the two. For example, in one embodiment, the electrodeposition paint solution 11 may generally comprise paint and water wherein the paint may be charged by an electrodeposition bath anode as will become appreciated later herein. In on particular embodiment, the water in the electrodeposition paint solution may comprise deionized water. In another embodiment, the paint in the electrodeposition paint solution 11 may comprise various paint ingredients such as, for example, resins, pigments, flatteners, dispersants, anti-settling agents, and/or any other ingredient that still allows for the electrocoating of the one or more parts 91, 92, 93.

As discussed above, the electrodeposition paint solution 11 in the electrodeposition bath 10 may be in contact with an electrodeposition bath anode 13. The electrodeposition bath anode 13 may comprise any anode that charges the paint in the electrodeposition paint solution 11 such that it electrocoats the one or more parts 91, 92, 93 submerged in the electrodeposition paint solution 11. For example, in one embodiment, such as where the volume of the electrodeposition bath 10 comprises about 45,700 gallons, a DC power supply may provide about 315 volts between the electrodeposition paint solution 11 and the one or more parts 91, 92, 93. In another embodiment, the electrodeposition bath 10 may comprise a plurality of electrodeposition bath anodes 13 such that the plurality of electrodeposition bath anodes 13 supply a more uniform charge throughout the entire electrodeposition paint solution 11. For example, where the electrodeposition bath 10 comprises a plurality of electrodeposition bath anodes 13, the plurality of electrodeposition bath anodes 13 may be disposed uniformly throughout the electrodeposition bath 10. In yet another embodiment, such as where the electrodeposition bath 10 comprises a single electrodeposition bath anode 13, the electrodeposition bath anode 13 may be disposed at approximately the center of the electrodeposition bath 10 or in close proximity with where the one or more parts 91, 92, 93 are submerged in the electrodeposition paint solution 11 in the electrodeposition bath 10. It should be appreciated that any other configuration of the electrodeposition bath anode 13 or the plurality of electrodeposition bath anodes 13 may also be realized which charges the paint in the electrodeposition paint solution 11 such that it can electrocoat the one or more parts 91, 92, 93 submerged therein.

Referring still to FIG. 1, in operation, the one or more parts may advance through the electrodeposition bath 10 to become electrocoated. For example, an uncoated part 91 may be transported to the electrodeposition bath 10 via the part carrier assembly 90. The part carrier assembly 90 may then advance the uncoated part 91 in the part carrier direction 94 so that it may be electrocoated. Specifically, as the part carrier assembly 90 advances, the uncoated part 91 becomes a submerged part 92 in the electrodeposition paint solution 11. As the submerged part 92 is submerged in the electrodeposition paint solution 11, paint in the electrodeposition paint solution 11, which is charged by the electrodeposition bath anode 13, is attracted to the submerged part 92. The submerged part 92 can thereby remain submerged to allow for sufficient time for the paint to completely coat the submerged part 92. After sufficient time has passed, the part carrier assembly 90 removes the electrocoated part 93 from the electrodeposition paint solution 11 in the electrodeposition bath 10 such that the electrocoated part 93 can advance towards the rinse tank 20.

Referring to FIG. 1, after the electrocoated part 93 is removed from the electrodeposition paint solution 11, the electrocoated part 93 can contain excess material such as paint, water or other particulates that can be rinsed off. Therefore, the electrocoated part 93 can transition to the rinse tanks 50, 60 and 20 to clean off excess material. The rinse tanks 56, 60, and 20 can comprise any apparatus operable to rinse one or more electrocoated parts 93 and be capable of fluid communication with the electrodeposition bath 10 so that fluid in the rinse tank 20 can flow from the rinse tank 20 to the electrodeposition bath 10, either directly or indirectly. For example, in one embodiment, the rinse tank 20 may comprise a rinse tank sprayer 22 and a rinse tank reservoir 21. The rinse tank sprayer 22 may be operable to spray the one or more electrocoated parts 93 to wash off excess paint and material. The rinse tank reservoir 21 may then capture the fluid from the rinse tank sprayer 22 and the excess material washed off from the one or more electrocoated parts 93 such that the fluid captured in the rinse tank reservoir 21 flows into the electrodeposition bath 10 (e.g., via the rinse tanks 50 and 60, which are also fluidly connected with the electrodeposition bath 10). The rinse tank reservoir 21 may therefore comprise any volume operable to collect the fluid prior to flowing to the electrodeposition path 10, such as, for example, about 1,320 gallons. For example, as illustrated in FIG. 1, the rinse tank 20 may be positioned above the electrodeposition bath 10 and the rinse tanks 50 and 60 such that as the rinse tank reservoir 21 overflows, it overflows into the rinse tanks 50, then 60 and eventually back into the electrodeposition bath 10.

The rinse tank sprayer 22 may spray any liquid, gas, or combinations thereof onto the one or more electrocoated parts 93 that allows for the removal of excess material there from. For example, in one embodiment, deionized water may be pumped to the rinse tank sprayer 22 from a separate source such that the deionized water mixes with the excess paint on the one or more electrocoated parts 93 and flows back into the electrodeposition bath 10. In another embodiment, the rinse tank sprayer 22 may spray water that was pumped and filtered water from the rinse tank reservoir 21 such that the water in the rinse tank 20 is continuously recirculated.

In one particular embodiment, as illustrated in FIG. 1, the electrodeposition painting system 100 further includes a filtering water circuit 101 where water from the electrodeposition bath 10 is filtered and a sterilizing circuit where electrode ions 12 are introduced to the filtered water. In some embodiments, the filtering water circuit 101 is connected to the sterilizing circuit 102 at the rinse tank 20. The filtering water circuit 101 may include a filter 30 that may be connected to the electrodeposition bath 10 that filters the electrodeposition paint solution 11 to separate filtered water from the paint such that the filtered water may be provided to the rinse tank (such as to the rinse tank sprayer 22 and/or to the rinse tank reservoir 21). For example, in such an embodiment, a solution collection line 31 may be connected to the electrodeposition bath so that it may capture some of the electrodeposition paint solution 11. The solution collection line 31 may then transport the electrodeposition paint solution to the filter 30 so that filtered water may be separated from the paint. The filter 30 can comprise any operable filter such as, for example, an ultrafiltration filter. A paint return line 32 may then return the paint back to the electrodeposition bath 10 such that it may rejoin the electrodeposition paint solution 11. Furthermore, a filtered water return line 33 may transport the filtered water to any numerous locations in the electrodeposition painting system 100. For example, in one embodiment, the filtered water return line 33 may transport the filtered water to the rinse tank 20 such as directly to the rinse tank sprayers 22 or the rinse tank reservoir 21 (as illustrated in FIG. 1). In another embodiment, the filtered water return line 33 may additionally or alternatively transport the filtered water to any additional rinse tanks 50, 60 (when present) or away from the electrodeposition painting system 100.

Figure 2:
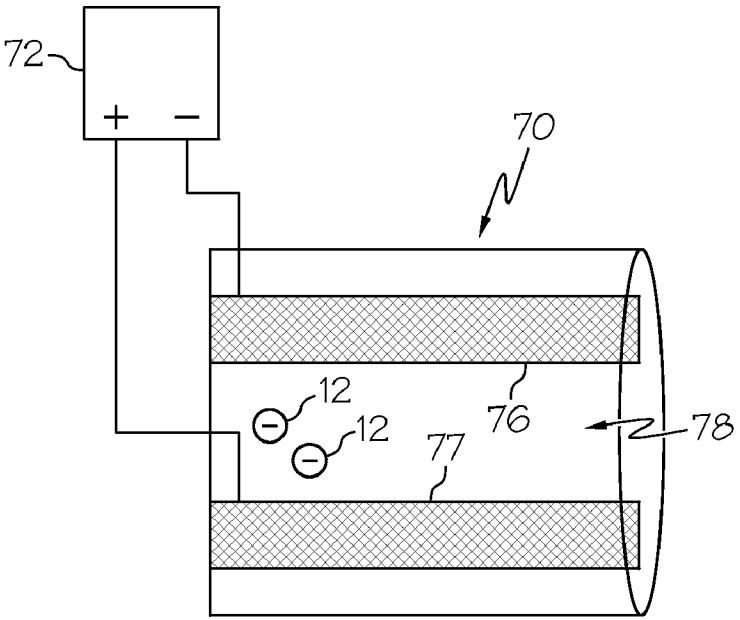
FIG. 2 depicts an ionizer assembly for an electrodeposition painting system according to one or more embodiments shown and described herein.

Referring now to FIGS. 1 and 2, the electrodeposition painting system 100 further comprises the sterilizing circuit 102 including an ionizer assembly 70 connected to the electrodeposition painting system 100 via a fluid conduit 40 to add electrode ions 12 to filtered water in the electrodeposition painting system 100. The fluid conduit 40 can generally comprise a recirculation pump 43 to circulate the filtered water to the ionizer assembly 70 and back to the rinse tank 20. For example, in one embodiment, the fluid conduit 40 may capture the filtered water directly from the filter 30 (see dotted line 37). In some embodiments, such as that illustrated in FIG. 1, the filtered water separated from the paint via the filter 30 may be returned to the rinse tank 20 and the fluid conduit 40 may the capture the filtered water from the rinse tank 20 itself. The fluid conduit 40 may otherwise capture filtered water anywhere about the electrodeposition painting system 100 such that electrode ions 12 may be added thereto as will become appreciated herein. Furthermore, the fluid conduit 40 may pump the filtered water at any flow rate that allows for the capturing of electrode ions 12 as will become appreciated herein. For example, in one embodiment, the filtered water may pass through the ionizer assembly 70 at a flow rate of from 2.0 meters per minute to 4.0 meters per minute. In one embodiment, such as that illustrated in FIG. 1, the fluid conduit 40 may further comprise an additional filter 44 to filter water from any other material such as paint. In another embodiment, the fluid conduit 40 may comprise a plurality of valves 45 disposed before the recirculation pump 43, the additional filter 44 and/or the ionizer assembly 70. In such an embodiment, the plurality of valves 45 may enable selective operation of various components such as the ionizer assembly 70 itself.

The ionizer assembly 70 can generally comprise one or more electrodes 76, 77 that can come into contact with the filtered water, and a power supply 72 connected to the one or more electrodes 76, 77. The electrodes 76, 77 can comprise any material that can produce electrode ions 12 when connected to a power supply as will become appreciated herein. For example, in one embodiment, the one or more electrodes 76, 77 can comprise copper (Cu). In another embodiment, the one or more electrodes 76, 77 can comprise copper-silver (CuAg). In yet another embodiment, the one or more electrodes 76, 77 may comprise any other transition metal or combinations thereof. Furthermore, the one or more electrodes may comprise any configuration that places them in contact with the filtered water such that electrode ions produced from the one or more electrodes 76, 77 can enter the filtered water and be carried back to the rinse tank 20 (such as directly to the rinse tank sprayer 22) or elsewhere in the electrodeposition painting system 100. For example, referring specifically to FIG. 2, a first electrode 76 and a second electrode 77 may be disposed in a channel 78 of the ionizer assembly 70. A power supply 72 may be connected to the first electrode 76 and the second electrode 77 such that as the filtered water passes through the channel 78, a plurality of electrode ions 12 enter the filtered water. As a result, the filtered water can carry the plurality of electrode ions 12 back to the electrodeposition painting system 100.

Figure 3:
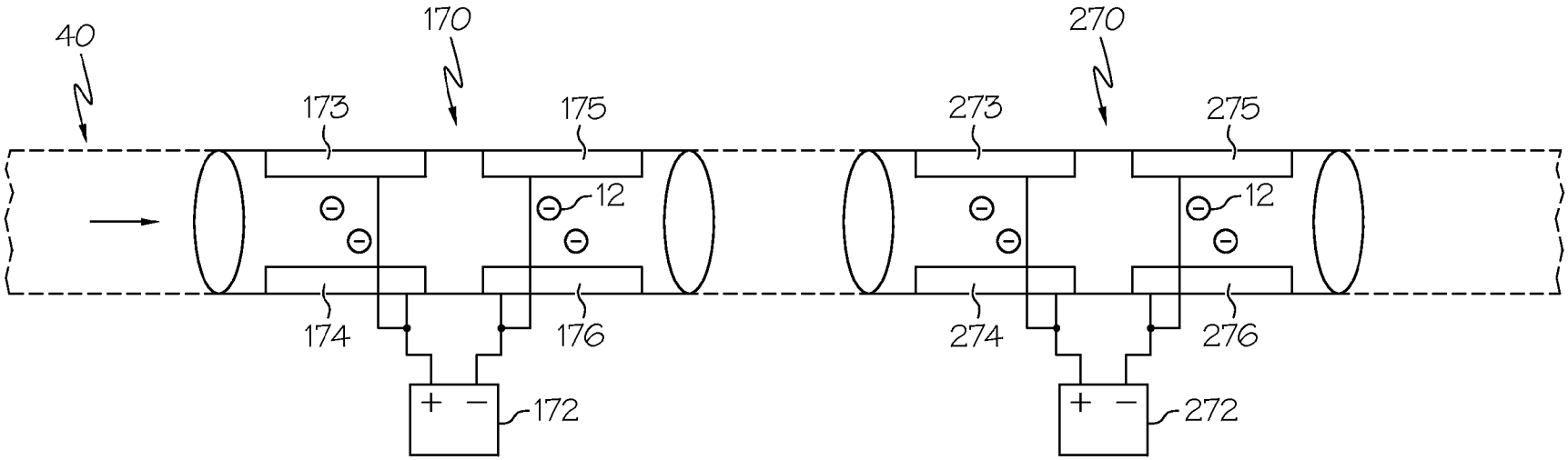
FIG. 3 depicts an ionizer assembly comprising a plurality of electrodes for an electrodeposition painting system according to one or more embodiments shown and described herein.

Referring now to FIG. 3, in one embodiment, the ionizer assembly 170 may comprise two sets of two electrodes each. For example, the ionizer assembly 170 can comprise a first set of electrodes 173, 174 and a second set of electrodes 175, 176 connected to a power source 172. The first set of electrodes 173, 174 and the second set of electrodes 175, 176 may thereby provide a plurality of electrode ions 12 to the filtered water as it flows from the fluid conduit 40 through the ionizer assembly 170. In another embodiment, an additional ionizer assembly 270 may also be connected to the fluid conduit 40 and also comprise two sets of two electrodes each. For example, the additional ionizer assembly 270 can comprise a third set of electrodes 273, 274 and a fourth set of electrodes 275, 276 connected to an additional power source 272. The third set of electrodes 273, 274 and the fourth set of electrodes 275, 276 may also thereby provide a plurality of electrode ions 12 to the filtered water. It should be appreciated that any other configuration of one or more ionizer assemblies 70, 170 comprising one or more electrodes 76, 77, 173, 174, 175, 176 may further be realized such that they are placed in contact with the filtered water such that the plurality of electrode ions 12 may enter the filtered water to form filtered water comprising electrode ions as appreciated herein.

The power supply 72 connected to the one or more electrodes 76, 77 of the ionizer assembly 70 can provide any amount of power that allows for electrode ions to enter the filtered water. For example, in one embodiment, the power supply may provide from about 18 volts to about 22 volts to the one or more electrodes. In another embodiment, the power supply may be adjusted based on the flow rate of the filtered water and/or the amount of the one or more electrodes in contact with the filtered water. For example, in one embodiment, the enough power may be supplied to the one or more electrodes 76, 77 such that they produce 0.5 parts per million to 1.0 parts per million electrode ions in the filtered water. In one particular embodiment, the current may be periodically reversed between the one or more electrodes 76, 77 so that the plurality of electrode ions 12 are produced from alternating electrodes 76, 77. In another embodiment, the one or more electrodes 76, 77 may be periodically replaced either in unison or in succession such that a consistent amount of electrode ions 12 may enter the filtered water. In even yet another embodiment, an ionizer control (not illustrated) may control the power produced by the power supply 72. For example, in such an embodiment, the ionizer control may base the amount of power produced by the power supply 72 on the current amount of electrode ions 12 in the filtered water and a target amount of electrode ions 12 in the filtered water. The ionizer control may cooperate with the power supply 72 in any other manner to control the amount of electrode ions 12 that enter the filtered water from the one or more electrodes 76, 77 as the filtered water passes through the ionizer assembly 70.

The filtered water comprising electrode ions may then return to the electrodeposition painting system 100 in one or more locations. For example, as illustrated in FIG. 1, the filtered water comprising electrode ions may return to the rinse tank sprayer 22 of the rinse tank 20 so that the one or more coated parts 93 are rinsed with the filtered water comprising electrodes. The filtered water comprising electrodes can then mix with the excess paint rinsed off of the one or more electrocoated parts 93 and collect in the rinse tank reservoir 21. From there, the contents of the rinse tank reservoir 21 (which now contains the filtered water comprising electrode ions) can flow back towards the electrodeposition bath 10 such that it mixes in with the electrodeposition paint solution 11. As a result, the filtered water comprising electrode ions will become dispersed throughout the electrodeposition painting system 100 such that the electrode ions can sterilize the electrodeposition paint solution 11 to reduce the amount of bacteria present therein. It should be noted that as used herein "sterilize" refers to reducing the amount of bacteria present in the electrodeposition paint solution 11. In another embodiment, the filtered water comprising electrode ions 12 may be returned elsewhere about the rinse tank 20 such as directly to the rinse tank reservoir 22. In yet another embodiment, the filtered water comprising electrode ions may be returned directly to the electrodeposition bath 10 so that it can enter the electrodeposition paint solution 11 without passing through the rinse tank 20. It should be appreciated that the filtered water comprising electrode ions may additionally or alternatively be returned to any other location about the electrodeposition painting system 100.

In one embodiment, such as that illustrated in FIG. 1, the part carrier assembly 90 may transport the one or more parts 91, 92, 93 through one or more additional rinse tanks to provide for a multi-stage rinsing process. For example, as illustrated in FIG. 1, a first rinse tank 50 may be disposed adjacent to the electrodeposition bath 10. The first rinse tank 50 may comprise a first rinse tank reservoir 51 and a first rinse tank sprayer 52. The first rinse tank 50 may be positioned between the rinse tank 20 and the electrodeposition bath 10 such that filtered water comprising electrode ions can flow from the rinse tank 20 to the first rinse tank 50 to the electrodeposition bath 10. Similarly, a second rinse tank 60 may also be disposed between the rinse tank 20 and the first rinse tank 50. The second rinse tank 60 may comprise a second rinse tank reservoir 61 and a second rinse tank sprayer 62. The second rinse tank 60 may be positioned between the rinse tank 20 and the first rinse tank 50 such that the filtered water comprising electrode ions can flow from the rinse tank 20 to the second rinse tank 60, to the first rinse tank 50, and finally to the electrodeposition bath 10. In the embodiment of FIG. 1, the rinse tank 20 may be a final rinse tank having rinse water of the highest purity since the rinse water in rinse tank 20 may be introduced thereto directly from the filter 30 and ionizer assembly 70.

After the one or more electrocoated parts 93 are rinsed in the rinse tank 20 (and potentially by the first rinse tank 50 and the second rinse tank 60), the electrocoated parts 93 can be transported to and undergo any post electrodeposition treatments. For example, in one embodiment the electrocoated parts 93 may then be blown dry to remove any remaining water from the rinse tank sprayer or other loose debris. In another embodiment, the one or more electrocoated parts 93 may pass through an oven, heat lamps or the like so that the paint is baked on. In yet another embodiment, the electrocoated parts 93 may undergo additional surface treatments such as receiving an additional paint coat, finish coat or the like. It should be appreciated that the electrocoated parts may alternatively or additionally undergo any other processing or treatment after they receive they are electrocoated.

It should now be appreciated that electrode sterilization via an ionizer assembly may be used in conjunction with an electrodeposition painting system to sterilize bacteria found in electrodeposition paint solutions. One or more parts can be electrocoated in an electrodeposition bath by being submerged in a charged electrodeposition paint solution. The one or more electrocoated parts may then be rinsed in a rinse tank to remove excess paint and material. Concurrently, the electrodeposition paint solution may be filtered to separate the paint from filtered water such that the paint may be recalculated to the electrodeposition bath and the filtered water may be returned to the rinse tank, the ionizer assembly and/or other places about the electrodeposition painting system. The filtered water may then pass through an ionizer assembly to receive a plurality of electrode ions from one or more electrodes connected to a power supply. Finally, the filtered water comprising electrode ions can be circulated throughout the electrodeposition painting system to sterilize bacteria.

It is noted that the terms "substantially" and "about" may be utilized herein to represent the inherent degree of uncertainty that may be attributed to any quantitative comparison, value, measurement, or other representation. These terms are also utilized herein to represent the degree by which a quantitative representation may vary from a stated reference without resulting in a change in the basic function of the subject matter at issue.

While particular embodiments have been illustrated and described herein, it should be understood that various other changes and modifications may be made without departing from the spirit and scope of the claimed subject matter. Moreover, although various aspects of the claimed subject matter have been described herein, such aspects need not be utilized in combination. It is therefore intended that the appended claims cover all such changes and modifications that are within the scope of the claimed subject matter.

What is claimed is:

1. An electrodeposition painting system comprising:

an electrodeposition bath containing an electrodeposition paint solution comprising paint and water, wherein the electrodeposition paint solution is in contact with an electrodeposition bath anode that charges the paint such that it electrocoats one or more parts submerged in the electrodeposition paint solution to form one or more electrocoated parts;

a rinse tank that rinses the one or more electrocoated parts, wherein a rinse tank reservoir of the rinse tank is capable of fluid communication with the electrodeposition bath;

a filter that filters the electrodeposition paint solution to separate filtered water from the paint; and an ionizer assembly comprising one or more electrodes in contact with the filtered water and a power supply connected to the one or more electrodes, wherein the power supply causes a plurality of electrode ions from the one or more electrodes to enter the filtered water to produce filtered water comprising electrode ions such that the filtered water comprising electrode ions flows into and sterilizes the electrodeposition paint solution.

2. The electrodeposition painting system of claim 1 wherein the rinse tank rinses the one or more electrocoated parts with the filtered water comprising electrode ions, the filtered water comprising electrode ions flowing from the rinse tank reservoir into the electrodeposition bath.

3. The electrodeposition painting system of claim 1 wherein the ionizer assembly comprises four electrodes in contact with the filtered water.

4. The electrodeposition painting system of claim 3 wherein the ionizer assembly comprises a second set of four electrodes in contact with the filtered water.

5. The electrodeposition painting system of claim 1 wherein the at least one electrode is disposed internal a fluid conduit.

6. The electrodeposition painting system of claim 5 wherein the ionizer assembly further comprises a recirculation pump in communication with the fluid conduit such that the filtered water is pumped through the fluid conduit.

7. The electrodeposition painting system of claim 1 wherein the ionizer assembly further comprises an ionizer control to control an amount of the plurality of electrode ions that enters the filtered water.

8. The electrodeposition painting system of claim 1 wherein the one or more electrodes comprises Cu or CuAg.

9. The electrodeposition painting system of claim 1 wherein the filtered water filtered from the paint is directed to the rinse tank.

10. The electrodeposition painting system of claim 1 wherein the paint filtered from the filtered water is returned to the electrodeposition bath.

11. The electrodeposition painting system of claim 1 wherein the rinse tank is a final rinse tank, the electrodeposition painting system further comprising a first rinse tank comprising a first rinse tank reservoir, wherein the first rinse tank is disposed between the electrodeposition bath and the final rinse tank such that the filtered water comprising electrode ions flows from the final rinse tank reservoir, to the first rinse tank reservoir and then to the electrodeposition bath.

12. The electrodeposition painting system of claim 11 further comprising a second rinse tank comprising a second rinse tank reservoir, wherein the second rinse tank is disposed between the first rinse tank and the final rinse tank such that the filtered water comprising electrode ions flows from the final rinse tank reservoir, to the second rinse tank reservoir, to the first rinse tank reservoir and then to the electrodeposition bath.

13. A method for electrode sterilizing in an electrodeposition painting system, the method comprising:

electrocoating one or more parts in an electrodeposition paint solution to form one or more electrocoated parts, wherein the electrodeposition paint solution comprises water and paint;

filtering out filtered water from the paint of the electrodeposition paint solution;

passing the filtered water through an ionizer assembly and adding a plurality of electrode ions to the filtered water to form filtered water comprising electrode ions;

rinsing the one or more electrocoated parts with the filtered water comprising electrode ions in a rinse tank; and collecting the filtered water comprising electrode ions in a rinse tank reservoir, the filtered water comprising electrode ions flowing into and sterilizing the electrodeposition paint solution.

14. The method of claim 13 wherein the filtered water comprising electrode ions comprises from 0.5 parts per million to 1.0 parts per million electrode ions in filtered water.

15. The method of claim 13 wherein the filtered water passes through the ionizer assembly at a flow rate from 2.0 meters per minute to 4.0 meters per minute.

16. The method of claim 13 wherein the ionizer assembly comprises a power supply connected to one or more electrodes, wherein the one or more electrodes is in contact with the filtered water.

17. The method of claim 16 wherein the power supply supplies from 18 volts to 22 volts to the one or more electrodes.

18. The method of claim 13 wherein the rinse tank is a final rinse tank, the one or more electrocoated parts are rinsed with deionized water in a first rinse tank prior to being rinsed with the filtered water comprising electrode ions in the final rinse tank.

19. An electrodeposition painting system comprising:

an electrodeposition bath containing an electrodeposition paint solution comprising paint and water, wherein the electrodeposition paint solution is in contact with an electrodeposition bath anode that charges the paint such that it electrocoats one or more parts submerged in the electrodeposition paint solution to form one or more electrocoated parts;

a rinse tank that rinses the one or more electrocoated parts, wherein a rinse tank reservoir of the rinse tank is capable of fluid communication with the electrodeposition bath;

a filtering water circuit in fluid communication with the electrodeposition bath configured to filter the paint from the water to provide filtered water; and a sterilizing circuit that receives filtered water from the rinse tank, the sterilizing circuit including an ionizer assembly that introduces electrode ions to the filtered water.

20. The electrodeposition painting system of claim 19, wherein the filtering water circuit is connected to the sterilizing circuit at the rinse tank, the sterilizing circuit delivering the filtered water including the electrode ions back to the rinse tank.

* * * * *